US010832314B2

(12) United States Patent
Endras et al.

(10) Patent No.: US 10,832,314 B2
(45) Date of Patent: Nov. 10, 2020

(54) SYSTEM AND METHOD OF AUTOMATIC NEGOTIATION IN VEHICLE AUCTIONS

(71) Applicant: NthGen Software Inc., Toronto (CA)

(72) Inventors: Mark Endras, Toronto (CA); Hon-Wai Chia, Toronto (CA)

(73) Assignee: NthGen Software Inc., Toronto (CA)

( * ) Notice: Subject to any disclaimer, the term of this patent is extended or adjusted under 35 U.S.C. 154(b) by 1211 days.

(21) Appl. No.: 14/676,702

(22) Filed: Apr. 1, 2015

(65) Prior Publication Data

US 2015/0278934 A1 Oct. 1, 2015

Related U.S. Application Data

(60) Provisional application No. 61/973,442, filed on Apr. 1, 2014.

(51) Int. Cl.
*G06Q 30/08* (2012.01)

(52) U.S. Cl.
CPC ..... *G06Q 30/08* (2013.01)

(58) Field of Classification Search
None
See application file for complete search history.

(56) References Cited

U.S. PATENT DOCUMENTS

2002/0032626 A1* 3/2002 DeWolf ..... G06Q 10/06 705/35
2002/0049642 A1* 4/2002 Moderegger ..... G06Q 30/0611 705/26.3
2002/0147655 A1* 10/2002 Say ..... G06Q 30/0609 705/26.3
2002/0194051 A1* 12/2002 Hall ..... G06Q 30/0275 705/7.31
2003/0018563 A1* 1/2003 Kilgour ..... G06Q 40/02 705/37
2004/0117293 A1* 6/2004 Lammle ..... G06Q 30/08 705/37
2004/0128224 A1* 7/2004 Dabney ..... G06Q 30/08 705/37
2004/0220884 A1* 11/2004 Khan ..... G06Q 30/08 705/80
2005/0177443 A1* 8/2005 Rodriguez ..... G06Q 30/08 705/26.3
2008/0300962 A1* 12/2008 Cawston ..... G06Q 10/06311 705/7.13

(Continued)

OTHER PUBLICATIONS

Steven Lang, "Confessions of an Auto Auctioneer" https://www.edmunds.com/car-buying/confessions-of-an-auto-auctioneer.html (Mar. 8, 2012) (Year: 2012).*

*Primary Examiner* — Paul R Fisher
(74) *Attorney, Agent, or Firm* — Lempia Summerfield Katz LLC

(57) ABSTRACT

Using an average historical price for vehicles of similar parameters, a method is provided that allows sellers and a best bidder, following an inconclusive auction for a vehicle, to negotiate with confidence a closing price for a sale of the vehicle. The method and system provides the ability for the best bidder (or a second-best bidder) to enter a new bid, and for the seller to accept a previous bid or the new bid, if any, in light of the average historical price, without reopening the auction broadly to other bidders. A post-auction negotiation engine is also provided.

26 Claims, 6 Drawing Sheets

(56) References Cited

U.S. PATENT DOCUMENTS

| | | | | |
|---|---|---|---|---|
| 2010/0070343 | A1* | 3/2010 | Taira | G06Q 10/067 705/400 |
| 2010/0088158 | A1* | 4/2010 | Pollack | G06Q 30/02 705/7.35 |
| 2013/0173393 | A1* | 7/2013 | Calman | G06Q 30/0207 705/14.66 |
| 2013/0290149 | A1* | 10/2013 | Rashwan | G06Q 30/0641 705/27.1 |
| 2014/0279168 | A1* | 9/2014 | Malaczynski | G06Q 30/0611 705/26.4 |

* cited by examiner

SYSTEM AND METHOD OF AUTOMATIC NEGOTIATION IN VEHICLE AUCTIONS

CROSS-REFERENCE TO RELATED APPLICATIONS

This application claims the benefit of U.S. Provisional Patent Application No. 61/973,442, filed Apr. 1, 2014 entitled "System and Method of Automatic Negotiation in Vehicle Auctions," which is incorporated herein by reference in its entirety.

FIELD OF INVENTION

The field of invention is generally related to e-commerce and in particular is related to inconclusive online automobile auctions whereby sellers and bidders can negotiate after the auction has timed out.

BACKGROUND

Historically barter, haggling, sale by a set-price and auctions have been some of the traditional ways to negotiate the exchange of goods and commodities.

An auction is a process of buying and selling goods or services by offering them up for bid, taking bids, and then selling the item to the highest bidder. Bidding is the act of participating in an auction by offering to purchase an item for sale. Prices are bid by buyers and asked (or offered) by sellers. Auctions are publicly and privately seen in several contexts and almost anything can be sold at an auction. Prior art auctioning methods exist, and they vary based on the different bidding procedures used in each kind of an auction.

Different types of auctions have their specific qualities such as pricing accuracy and time required for preparing and conducting the auction. Some well known auction types are briefly described below:

English Auction—also known as an open ascending price auction. This type of auction is arguably the most common form of auction in use today. Participants bid openly against one another, with each subsequent bid required to be higher than the previous bid.

Dutch Auction—also known as an open descending price auction. In the traditional Dutch Auction the auctioneer begins with a high asking price which is lowered until some participant is willing to accept the auctioneer's price. The winning participant pays the last announced price. The Dutch Auction is named for its best known example, the Dutch tulip auctions.

Sealed first-price auction, also known as a first-price sealed-bid auction—is a type of auction where all bidders simultaneously submit sealed bids. The highest bidder pays the price they submitted. This type of auction is distinct from the English Auction, in that bidders can only submit one bid each, bidders cannot see the bids of other participants therefore they cannot adjust their own bids accordingly.

No-reserve auction (NR), also known as an absolute auction, is an auction in which the item for sale will be sold regardless of price.

Reserve Auction—is an auction where the item for sale may not be sold if the final bid is not high enough to satisfy the seller. In this type of auction the seller reserves the right to accept or reject the highest bid. In these cases a set 'reserve' price known to the auctioneer, but not necessarily to the bidders, may have been set, below which the item may not be sold. The reserve price may be fixed or discretionary.

In the latter case, the decision to accept a bid is deferred to the auctioneer, who may accept a bid that is marginally below the reserve price.

Reserve price—A minimum acceptable price established by the seller prior to the auction, which may or may not be disclosed to the bidders.

An appraisal is an estimate of an item's worth, usually performed by an expert and may be used as a mechanism to define a reserve price.

Silent Auction—is a variant of the English auction in which bids are written on a sheet of paper. At the predetermined end of the auction, the highest listed bidder wins the item. This auction is often used in charity events, with many items auctioned simultaneously and "closed" at a common finish time. The auction is "silent" in that there is no auctioneer selling individual items, the bidders writing their bids on a bidding sheet often left on a table near the item. At charity auctions, bid sheets usually have a fixed starting amount, predetermined bid increments, and a "guaranteed bid" amount which works the same as a "buy now" amount. Other variations of this type of auction may include sealed bids. The highest bidder pays the price he or she submitted.

E-Bidding or Electronic Bidding—is a type of auction, whereby a person may make a bid without being physically present at an auction or where the entire auction is taking place on the Internet.

Auctions are prone to collusion and whenever bidders at an auction are aware of the identity of the other bidders there is a risk that they may form a "ring" and thus manipulate the auction result. By agreeing to bid only against outsiders, never against members of the "ring", competition becomes weaker, which may dramatically affect the final price level. After the end of the official auction an unofficial auction may take place among the "ring" members. The difference in price between the two auctions could then be split among the members.

In an English auction a dummy bid is a bid made by a dummy bidder acting in collusion with the auctioneer or vendor, designed to deceive genuine bidders into paying more. In a first price auction a dummy bid is an unfavourable bid designed so as not to become the winning bid.

Online auctions mitigate some of the aspects of collusion mentioned above as the bidders are generally anonymous, not known to each other and sellers cannot manipulate the bidders. Online auctions for vehicles are common where a wide variety of off-lease, commercial and dealer vehicles may be sold to other dealers and the public. Some dealers may auction one or more vehicles to other dealers who in turn sell these to the public via their showrooms.

One issue with online auctions for vehicles is that many times an auction may end without a transaction as no bidder has bid an amount that was the expected value in the mind of the seller. Sellers typically have a reserve price in mind but this reserve price is not disclosed to the bidders. When this reserve price is not met, the seller may opt to end the auction or the auction may run out of time. Thus another auction has to be initiated, consuming more time and effort, and this may again result in a stalemate. Sometimes this cycle goes on several times before a final bid is accepted by the seller.

It would be desirable to provide a simple means for negotiation to continue between the seller and a best bidder following the inconclusive auction.

SUMMARY

Broadly speaking, the present invention relates to a system and method of automatic negotiation in a vehicle auction. The system and method of the invention provide a bidder and a seller with the ability to negotiate after an auction has ended or where the auction time has lapsed, there was at least one bid, and no sale transaction has been made.

The system may run on a server that is accessible to sellers and bidders. Sellers can start an auction while bidders participate in the auction by placing bids on the vehicle being auctioned by the sellers.

In one embodiment an application may be provided (either generic or purpose built), which allows the electronic bids to be received by this application digitally. The application may be specific for a particular mobile device e.g. an iPhone or a Google Android phone, or a tablet computer etc. or generic e.g. Flash or HTML5 based app that can be used in a browser. In one embodiment the electronic bids may be received via e-mail, text message, IM, phone call etc. if the seller does not have the app of invention installed on his mobile device.

In one embodiment bidders and sellers may use connected devices e.g. a Smartphone, a tablet, or a personal computer to connect with the system of invention e.g. using a browser on a personal computer to access the website or via an app on a mobile device. Such an app may be downloaded, for example, from an AppStore. Devices where the invention can advantageously be used may include but are not limited to an iPhone, iPad, Smartphones, Android phones, personal computers e.g. laptops, tablet computers, touch-screen computers running any number of different operating systems e.g. MS Windows, Apple iOS, Linux, Ubuntu, etc.

The vehicle listed in the auction may be first identified, including its make, model, year, installed options, mileage, color, region where the vehicle is from, its condition, its history etc. The Top Bid that was received earlier in the auction may be compared to the Average Historical Price (AHP) for vehicles having those parameters in the region. For example, the AHP of a vehicle may be determined by using the historical sales data for each vehicle of a given make, model and year in a particular region. The difference between the AHP and the Top Bid may be calculated and communicated to the Seller and the Top Bidder. Both the Seller and Top Bidder may then be encouraged to bridge the gap between the AHP and the Top Bid. In order to bridge the gap between the AHP and Top bid, a Top Bidder may place a new bid that is closer to or equal to the AHP. Alternatively the Seller may reconsider the previous Top Bid and accept it as a winning bid. Finalize negotiation between Top Bidder and Seller. After successful negotiation, the auction may be finalized.

The region can be the area e.g. city, state, country where the auction is being held or the area e.g. city state, country where the vehicle was originally from or where the vehicle or seller is located.

When the Seller accepts the electronic bid the system may automatically perform a transaction that may include monetary exchange via cash, credit card, debit card or other such means.

In certain embodiments, it may be desirable to perform or consider a more accurate vehicle assessment instead of the Average Historical Price. When calculating the assessed value of a vehicle its specific installed options; its condition e.g. any accidents, any dents, any re-paints etc; its history e.g. whether the vehicle is single owner, multi-owner, was it a previous daily rental, the region where the vehicle was driven etc. may be used.

If the difference between the AHP of the vehicle in the auction and the previous top bid is small, the system of invention may contact both the seller and the top bidder to negotiate. The AHP price may be shared with both the seller and the top bidder and the system may suggest that they bridge the gap. If the difference between the AHP of the vehicle in the auction and the previous top bid is large, the system may contact the top bidder, share the AHP with the top bidder and suggest that a new bid closer to the AHP be made. If the difference between the AHP of the vehicle in the auction and the previous top bid is negative, that is the top bid is higher than the AHP, then the system may contact the seller, share the AHP with the seller and suggest that the seller take the previous bid as it is more than the AHP for that vehicle. In order to bridge the gap between the AHP and Top Bid, a Top Bidder may place a new bid that is closer to, equal to or higher than the AHP. Alternatively the Seller may reconsider the previous Top Bid and accept it as a winning bid. Note that the system may refer to a Best Bid instead of a Top Bid (the Best Bid may not necessarily be the Top Bid, but may take into account other affinity factors).

Once the seller has accepted the bid, negotiation may be finalized between Seller and Top Bidder and the auction closed. When the Seller accepts the electronic bid the system may automatically perform a transaction that may include monetary exchange via cash, credit card, debit card or other such means.

There may be a provision for offering the first chance to the top bidder to negotiate with the seller so as to conclude an auction. If a top bidder does not take the offer to negotiate, then the system may offer the next in line bidder an opportunity to negotiate. Thus, the system may continue down the list of bidders until either a winning bid has been received or all bidders have either rejected the offer to negotiate or the seller has not accepted any of the bids (or until a post-auction time limit has expired).

There may be a provision for offering a best fit bidder the first chance to negotiate with the seller. The system may create a list of best fit bidders and if the first in line best fit bidder does not take the offer to negotiate, then offer the next in line bidder to negotiate. This may be continued until either a winning bid has been received or all bidders have either rejected the offer to negotiate or the seller has not accepted any of the bids (or until a post-auction time limit has expired). The best fit bidder may be selected based on affinity with desirable buyer characteristics set by the seller, or affinity based on the bidder previous buying or bidding patterns, or other profile attributes or preferences of the bidder.

According to a first aspect of the invention, a method is provided for computer-mediated negotiation following an inconclusive online auction of a vehicle offered for sale by a seller. The vehicle has at least one parameter. A computer retrieves a universe of historical pricing data of vehicles having the same or similar at least one parameter, and establishes an average historical price. Following the inconclusive online auction of the vehicle, it is determined that there was at least one bid in the online auction and that the seller did not accept any bid during the online auction; A best bidder from the online auction is also determined. The best bidder has a previous best bid that was not accepted by the seller during the online auction. The previous best bid and the average historical price are communicated to the best bidder and the seller. The seller and the best bidder are then permitted, in light of the average historical price, to negotiate a closing price for a transaction of the vehicle without reopening the auction broadly to other bidders.

A difference (delta) between the previous best bid and the average historical price may also be determined and communicated to the best bidder and/or the seller.

$$\Delta = \text{Best Bid}_v - AHP_v$$

If the difference is below a predetermined threshold, a message may be communicated to the best bidder and the seller suggesting that they bridge the gap. If the difference is above a predetermined threshold, a message may be communicated to the best bidder encouraging the best bidder to enter a new bid that is closer to or matching the average historical price. Note that this predetermined threshold may be a vehicle- and transaction-specific reserve set by the seller, or it may be a threshold set by the system (e.g. based on an absolute dollar amount, or a percentage of the AHP).

If the previous best bid is greater than the average historical price, a message may be communicated to the seller encouraging the seller to re-consider and accept the previous best bid.

The method may include permitting the best bidder to enter a new bid for consideration by the seller.

The method may include permitting the seller to accept the previous best bid or the new bid, if any.

Payment of the closing price may also be facilitated.

The permitting step may be time-limited. Following expiry of the time limit without a negotiated closing price, the seller and a second-best bidder may be permitted, in light of the average historical price, to negotiate a closing price for a transaction of the vehicle without reopening the auction broadly to other bidders.

The at least one parameter may include a region (e.g. a location of the auction, current location of the vehicle, current location of the seller, or where the vehicle was last registered).

The at least one parameter may include at least one parameter selected from the group consisting of a make, model, year, options, mileage, color, condition, and history of the vehicle. The at least one parameter may also include whether the vehicle is single- or multi-owner, and/or whether the vehicle was previously a daily rental.

The best bidder may be the bidder from the online auction having the highest previous best bid, or may be the bidder from the online auction having a highest best fit score for the vehicle being offered for sale, or a set of bidder characteristics desired by the seller.

According to a second aspect of the invention, a post-auction negotiation engine is provided for a system having an auction module that conducts online auctions for vehicles offered for sale by sellers. The auction module is programmed for receiving bids from a plurality of bidders, and is programmed to determine that an auction has timed out without a successful bid by any of the bidders including a best bidder having a previous best bid. The engine comprises:

- a calculation module programmed for determining an average historical price from a universe of historical pricing data of vehicles having at least one parameter in common with a target vehicle;
- a communication module programmed for:
  - receiving an indication from the auction module that an auction of the target vehicle timed out without a successful bid; and
  - communicating the average historical price of the target vehicle to the seller and at least one of the bidders from the auction; and
- a negotiation module programmed for receiving a new bid from one of the bidders from the auction after the auction has timed out and following communication of the average historical price, the negotiation module being programmed to receive the new bid without reopening the auction broadly to all bidders.

In one embodiment, the at least one bidder is the best bidder. The communication module may be further programmed for communicating the previous best bid to the seller and the at least one bidder.

DETAILED DESCRIPTION

Figure 1:
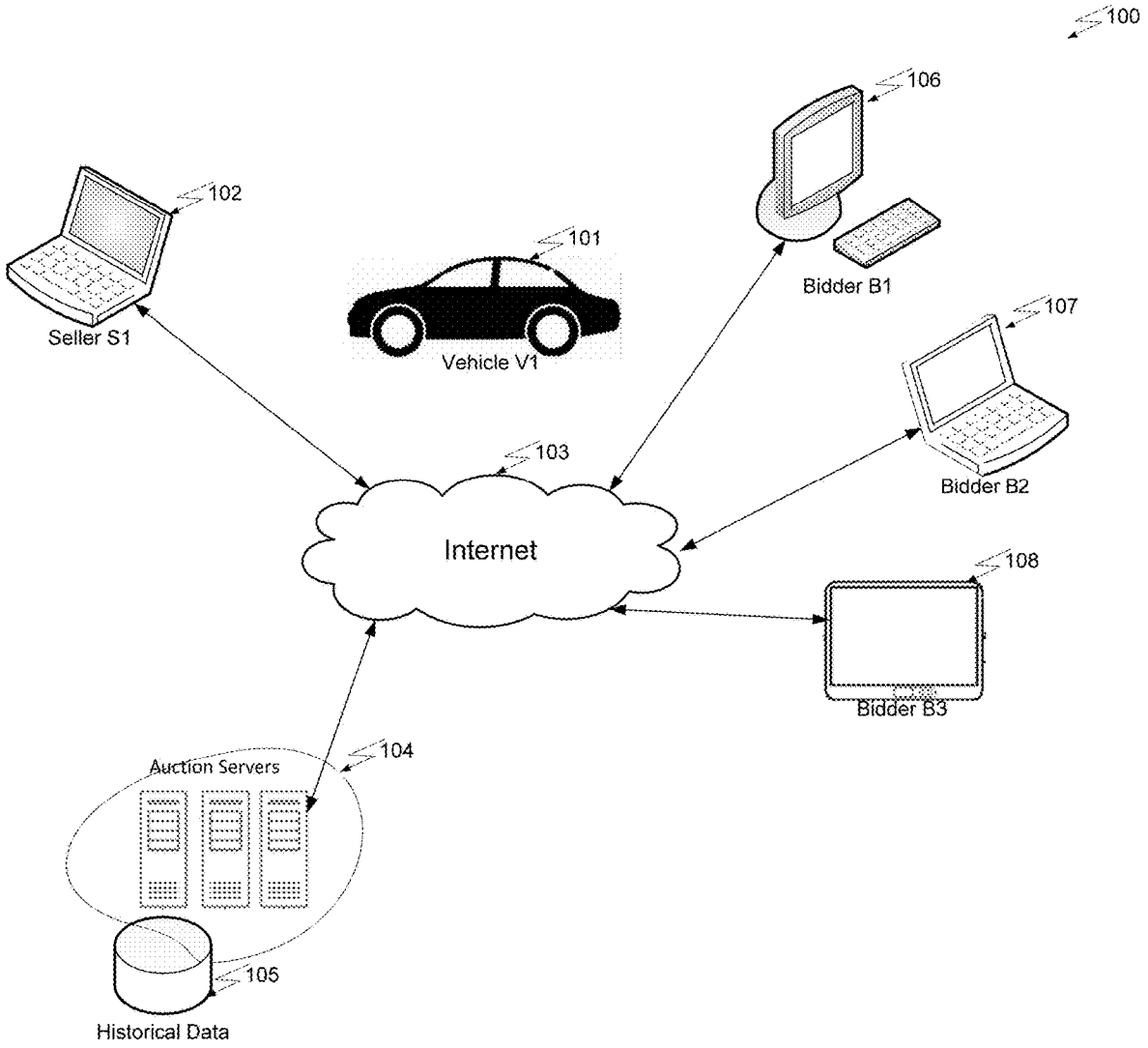
FIG. 1 is a sample network diagram illustrating communication flows among seller and bidders through an auction server accessible over the Internet.

Before embodiments of the invention are explained in detail, it is to be understood that the invention is not limited in its application to the details of the examples set forth in the following descriptions or illustrated drawings. The invention is capable of other embodiments and of being practiced or carried out for a variety of applications and in various ways. Also, it is to be understood that the phraseology and terminology used herein is for the purpose of description and should not be regarded as limiting.

Before embodiments of the software modules or flow charts are described in detail, it should be noted that the invention is not limited to any particular software language described or implied in the figures and that a variety of alternative software languages may be used for implementation.

It should also be understood that many components and items are illustrated and described as if they were hardware elements, as is common practice within the art. However, one of ordinary skill in the art, and based on a reading of this detailed description, would understand that, in at least one embodiment, the components comprised in the method and tool are actually implemented in software.

The present invention may be embodied as a system, method or computer program product. Accordingly, the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present invention may take the form of a computer program product embodied in any tangible medium of expression having computer usable program code embodied in the medium.

In order to provide a context for the various aspects of the disclosed invention, as well as the following discussion are intended to provide a brief, general description of a suitable environment in which the various aspects of the disclosed invention may be implemented. While the invention has been described in the general context of computer-executable instructions of a program that runs on one or more computers, those skilled in the art will recognize that the invention also may be implemented in combination with other program modules. Generally, program modules include routines, programs, components, data structures, etc. that perform particular tasks and/or implement particular abstract data types. Moreover, those skilled in the art will appreciate that the system and method of the invention may be practiced with other computer system configurations, including single-processor, multiprocessor or multi-core processor computer systems, mini-computing devices, mainframe computers, as well as personal computers, hand-held computing devices (e.g., personal digital assistant (PDA), phone, watch or other electronic gadgets incorporating the capacity to compute), microprocessor-based or programmable consumer or industrial electronics, and the like. The illustrated aspects may also be practiced in distributed computing environments where tasks/routines/processes etc. are performed by remote processing devices that are linked through a communications network e.g. a local area network (LAN) or the Internet. However, some, if not all aspects of the invention may be practiced on stand-alone computer(s). In a distributed computing environment, program modules may be located in both local and remote memory storage devices.

Computer program code for carrying out operations of the present invention may be written in any combination of one or more programming languages, including an object oriented programming language such as Java, Smalltalk, C++ or the like and conventional procedural programming languages, such as the "C" programming language or similar programming languages. Computer code may also be written in dynamic programming languages that describe a class of high-level programming languages that execute at runtime many common behaviours that other programming languages might perform during compilation. JavaScript, PHP, Perl, Python and Ruby are examples of dynamic languages. Additionally computer code may also be written using a web programming stack of software, which may mainly be comprised of open source software, usually containing an operating system, Web server, database server, and programming language. Some embodiments may use well-known open-source Web development platforms using Linux, Apache, MySQL and PHP. Other examples of environments and frameworks using which computer code may also be generated are Ruby on Rails which is based on the Ruby programming language, or node.js which is an event-driven server-side JavaScript environment.

The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Computing devices that enable a user to engage with internet in general may include a memory for storing a control program and data, and a processor (CPU) for executing the control program and for managing the data, which includes user data resident in the memory and includes buffered content. The computing device may be coupled to a video display such as a television, monitor, or other type of visual display while other devices may have it incorporated in them (iPad, iPhone etc.). An application or an app or other simulation may be stored on a storage media such as a USB memory key, flash memory, or other type of memory media all collectively referred to as "removable media" in this disclosure. The app may also be downloaded from the internet. The removable media can be inserted to the console of a computing device where it is read. The console can then read program instructions stored on the removable media and present a user interface to the user. The user interface may preferably be a graphical user interface (GUI). Example of such computing devices are personal computers e.g. a laptop or a Mac, a Smartphone, a tablet, a SmartTV, etc.

FIG. 1 shows a network view of the preferred embodiment 100. Vehicle V1 101 is being auctioned by Seller S1 102.

Auction is being conducted online and is accessible via the Internet 103. The auction is managed by online servers 104, and database 105 contains the information related to the seller, the bidders and the bids they make.

Preferably the bidders and sellers may connect to the system using a connected device e.g. a Smartphone, a tablet, or a personal computer e.g. using a browser on a personal computer to access the website or via an app on a mobile device. In one embodiment the app of invention may be downloaded from an AppStore.

As shown for illustration, auction servers 104 are connected via the Internet 103 to bidder B1 106 who is using a desktop computer to participate in the auction, Bidder B2 107 who is using a laptop and Bidder B3 108 who is using a tablet to participate in the auction.

In the preferred embodiment the system and method may be implemented on a server such that it is accessible over the Internet through a computing device, e.g. a browser on a personal computer or a browser on a mobile device like a Smartphone, a tablet or the like. Devices where the invention can be advantageously used include but are not limited to personal computers e.g. laptops, tablet computers, touch-screen computers running any number of different operating systems e.g. MS Windows, Apple iOS, Linux, Ubuntu, etc. Smartphones like an iPhone, an Android phone, tablets like iPad and the like.

In some embodiments, the device is portable. In some embodiments, the device has a touch-sensitive display with a graphical user interface (GUI), one or more processors, memory and one or more modules, programs or sets of instructions stored in the memory for performing multiple functions. In some embodiments, the user interacts with the GUI primarily through finger contacts and gestures on the touch-sensitive display. Instructions for performing different functions may be included in a computer readable storage medium or other computer program product configured for execution by one or more processors. The code is specialized to execute functions described herein which enable a smoother and more efficient technological process.

The system and method of the invention provides Seller S1 102 with the ability to create an auction. A user interface is provided whereby Seller S1 102 can add details about Vehicle V1 101 e.g. make, model, year, installed options, mileage, color, region where the vehicle is from, a description to provide further details, photos, and other details as needed. There may be a drop down menu from where a seller may select these details, or there may be radio buttons to make selections or a seller may select the required features from a list by putting check marks, etc. These details may vary from one implementation to another and the above are exemplary.

The preferred embodiment may provide a graphical user interface utilizing which bidders B1, B2 and B3 may participate in the auction by bidding for Vehicle V1 101. The graphical user interface may provide a method for bidders to place bids in an auction. For example there may be a drop down menu or a list with selection radio buttons, free form text box where a bid figure can be added or any other user friendly method that is conducive for use on mobile devices especially ones with touch screens.

Figure 2:
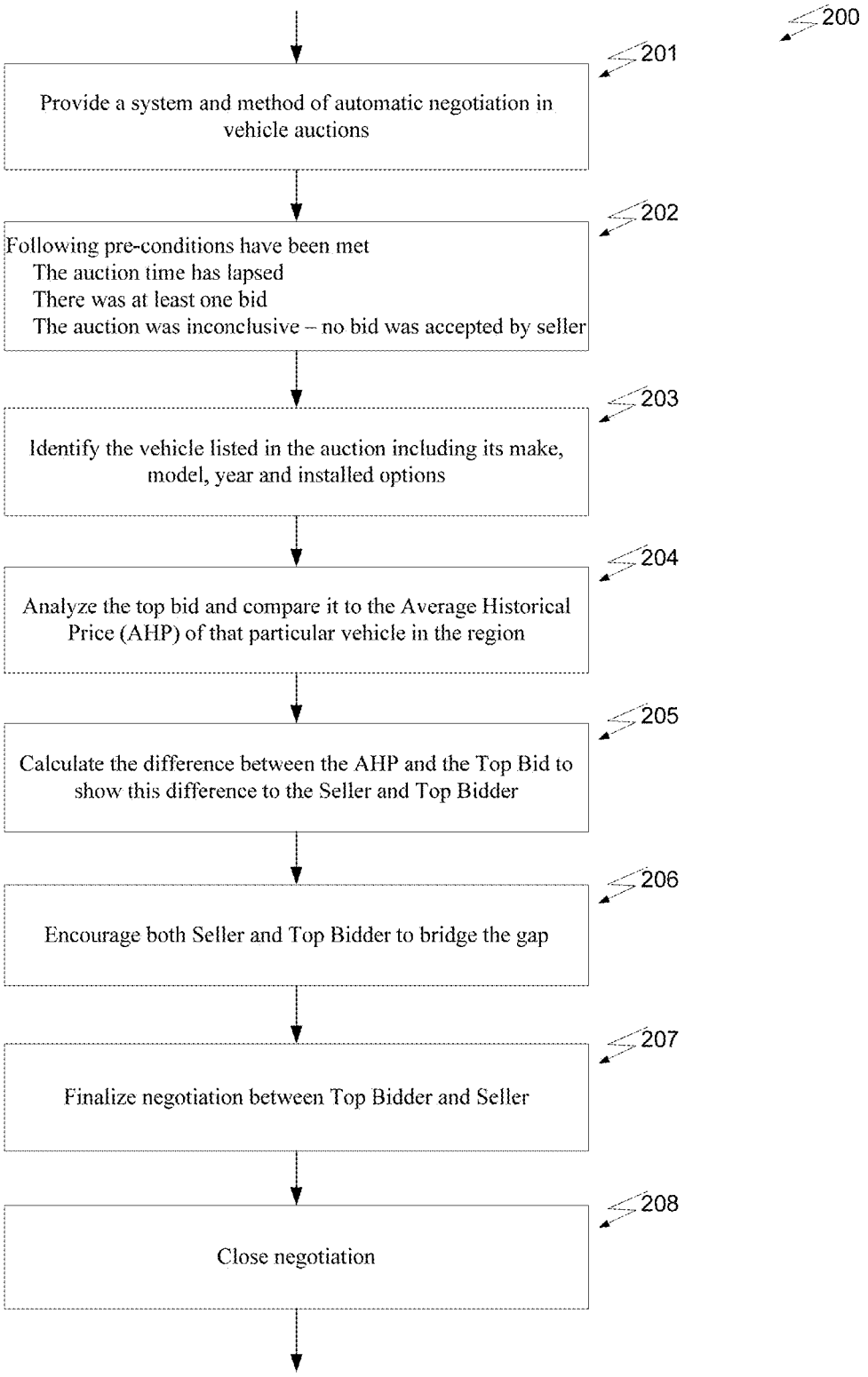
FIG. 2 is a flow diagram illustrating a basic method of automatic negotiation following an inconclusive vehicle auction.

FIG. 2 shows a preferred embodiment of the method 200. A system and method are provided for automatic negotiation in vehicle auctions 201. The system may run on a server that is accessible to sellers and bidders. Sellers can start an auction while bidders participate in the auction by placing bids on the vehicle being auctioned by the sellers.

In one embodiment bidders and sellers may use connected devices e.g. a Smartphone, a tablet, or a personal computer to connect with the system e.g. using a browser on a personal computer to access the website or via an app on a mobile device. In one embodiment the app may be downloaded from an AppStore.

As mentioned earlier, prior art auctions can end in a stalemate where the top bid may not be the winning bid, as the reserve price that is in the mind of a seller may be higher than the top bid. Therefore the starting point is a stalemate in an auction where the auction time has lapsed, there was at least one bid and the auction was inconclusive as no bid was accepted by the seller 202.

The vehicle listed in the auction may first be identified, including its make, model, year, installed options, mileage, color, region where the vehicle is from, vehicle condition, vehicle history etc. 203. The system and method may preferably use a database that contains the historical data on the sale of vehicles in a region, or a country or globally. The historical data for different makes and models of vehicles may be acquired from third parties or may accumulate in the system as more sellers and bidders interact with it. The historical data may also contain prices of different makes and models per year and region.

The Top Bid that was received earlier in the auction may be analyzed and compared to the Average Historical Price (AHP) of that particular vehicle in the region 204. Using the historical data an Average Historical Price (AHP) may be determined for each vehicle of a given make, model and year.

In one embodiment a more accurate vehicle assessment may be used instead of the Average Historical Price. When calculating the assessed value of a vehicle additional information like its specific installed options; its condition e.g. any accidents, any dents, any paints jobs, any major or minor repairs etc; its history e.g. whether the vehicle is single owner, multi-owner, was it a previous daily rental, the region where the vehicle was driven etc. any major or minor recalls of the vehicle by the manufacturer may be used amongst other things. This list is exemplary and is not indented to be exhaustive, in fact the intent is to cover all such sets of information that may be useful in determining the suggested bid to the bidders.

The price of a vehicle is dependent on its make, model, year, mileage, installed options amongst other factors and the region where the vehicle had been used in the past. For example a vehicle with a given make, model, year that was driven in Los Angeles, Calif. may fetch a better price than a similar vehicle with the same make, model and year that was driven in New York, N.Y. This difference in price may be due to worse winter conditions in NY and the use of salt on the roads in the winter which may make the vehicle's body prone to corrosion and rust.

In one embodiment the region can be the area e.g. city, state, country where the auction is being held. In another embodiment the region can be the area e.g. city state, country where the vehicle was originally from.

In yet another embodiment the region can be the area e.g. city, state, country such that it relates to the value of a vehicle from a first region being auctioned in a second region e.g. a CA convertible BMW M6 being auctioned in NY.

The difference between the AHP and the Top Bid may be calculated and this difference shown to the Seller and the Top Bidder 205. In order to calculate the difference between the AHP and the Top Bid, subtract the Top Bid value from the AHP.

Both Seller and Top Bidder may be encouraged by the system to bridge the gap between the AHP and the Top Bid 206. In one embodiment there may be an application either generic or purpose built, such that the electronic bids are sent by this application digitally. The application may be specific for a particular mobile device e.g. an iPhone or a Google Android phone, or a tablet computer etc. or generic e.g. Flash or HTML5 based app that can be used in a browser.

In one embodiment there may be an application either generic or purpose built, such that the electronic bids are received by this application digitally. The application may be specific for a particular mobile device e.g. an iPhone or a Google Android phone, or a tablet computer etc. or generic e.g. Flash or HTML5 based app that can be used in a browser.

In one embodiment of the invention the electronic bids may be received via e-mail if seller does not have the app of invention installed on his mobile device.

In order to bridge the gap between the AHP and Top bid, a Top Bidder may place a new bid that is closer to or equal to or higher than the AHP. Alternatively the Seller may reconsider the previous Top Bid and accept it as a winning bid.

In one embodiment the system may also provide a notification service. The notification service may provide a notification to a seller that a bid has been sent by bidder. The notification service may also provide a notification to a bidder that the seller has either accepted or rejected the bid made by the bidder. The notification service of the system of the invention may also provide periodic reminders.

The notifications/reminders from the notification service may be presented to the seller and/or bidders via in-app messaging, e-mail, text message, phone call, voicemail, or via social networks e.g. Facebook page, Google+, Twitter etc. by preferably adding a link on the homepage of a bidder/seller on a social media website e.g. Facebook homepage.

Negotiation may be finalized between Top Bidder and Seller 207. The negotiation may be closed by finalizing the auction 208. In one embodiment when the Seller accepts the electronic bid the system may automatically perform a transaction that may include monetary exchange via cash, credit card, debit card or other such means.

In one embodiment a more vehicle specific assessed value may be used to bridge the gap between the previous top bid and the reserve price in the mind of a seller. Thus a more accurate vehicle assessment may be used instead of the Average Historical Price. When calculating the assessed value of a vehicle its specific condition, installed options, its history e.g. whether the vehicle is single owner, multi-owner, was it a previous daily rental, the region where the vehicle was driven etc. may be used.

Figure 3:
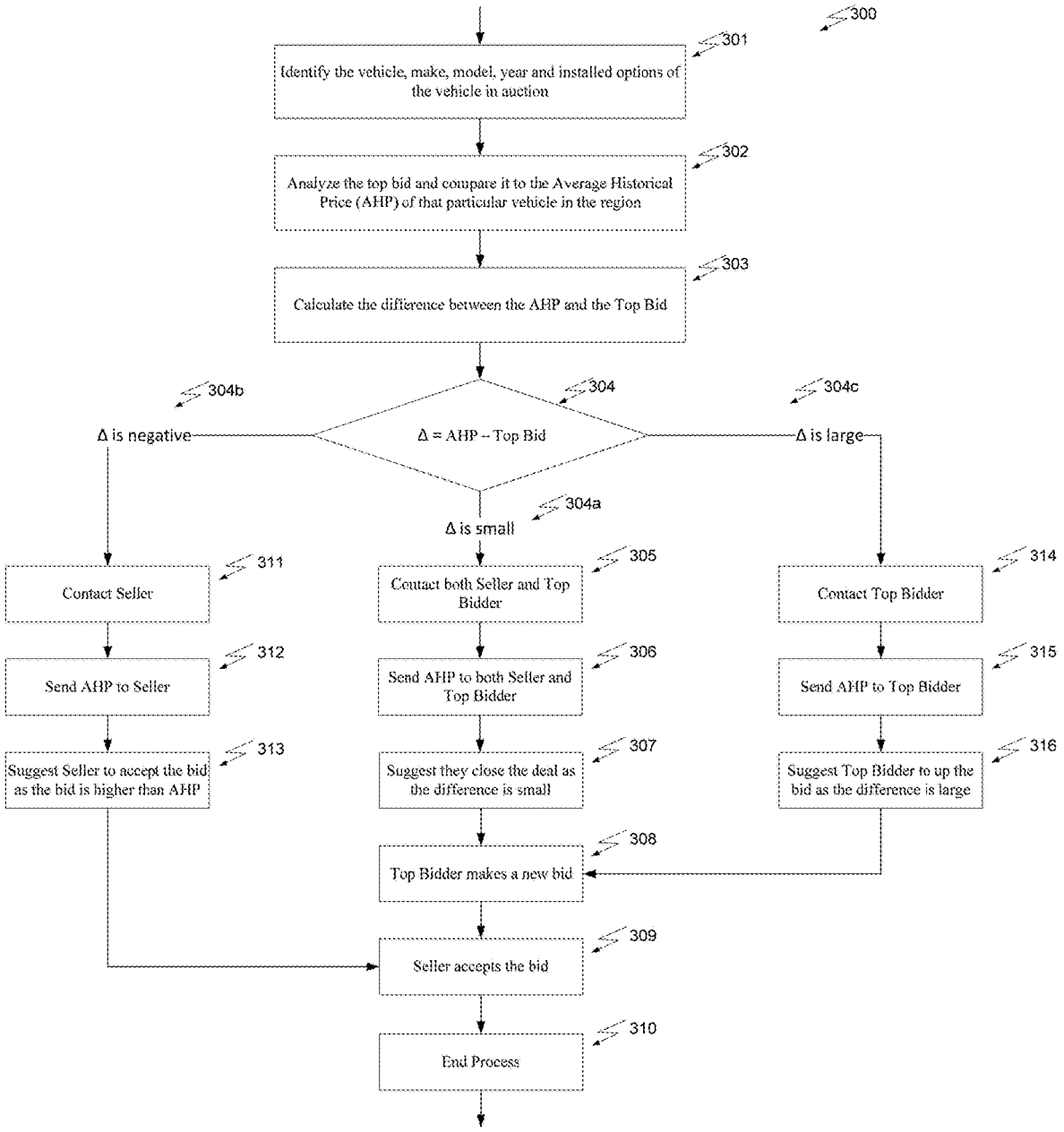
FIG. 3 is a flow diagram illustrating the method with diverse communication and post-auction negotiation options depending on the delta (difference) between the average historical price and the top bid (or best bid).

FIG. 3 shows one embodiment 300. The vehicle listed in the auction may first be identified, including its make, model, year, installed options, mileage, color, region where the vehicle is from etc. 301. The aforementioned list of factors is exemplary and in other implementations different factors may be used. The invention is not limited to these examples but the intent is to cover all such factors that can influence the resale price or value of a vehicle. Additionally any number of different combinations and permutations of these factors may be used in other embodiments.

The Top Bid that was received earlier in the auction may be analyzed and compared to the Average Historical Price (AHP) of that particular vehicle in the region 302. Using the historical data an Average Historical Price (AHP) may be determined for each vehicle of a given make, model and year. For a vehicle with a given make, model, year, mileage etc. the AHP may vary by region or country. The AHP may be calculated as often as necessary. In one embodiment when new sales data is received in the database, the AHP for all vehicles in the database may be recalculated. AHP may be calculated once a day, once a week, once a month, once a quarter, once a year or as often as needed. AHP may also be calculated on demand or when a certain condition is met.

The difference between the AHP and the Top Bid may be calculated and shown to the Seller and the Top Bidder 303. In order to calculate the difference between the AHP and the Top Bid, subtract the Top Bid value from the AHP.

The delta between AHP and Top bid may be checked 304. If the delta is small 304*a* the system may contact both Seller and Top Bidder 305. The electronic message to negotiate may be received by either the seller or a bidder in the app. If bidder does not have the app installed on their mobile device, the message may be sent in an e-mail preferably along with a link to download the app.

The electronic message to negotiate may also be presented to the seller via an e-mail, a text message, a voice mail, a link being added to the homepage on a social media website e.g. Facebook homepage.

The AHP may be sent to both Seller and Top bidder 306. The AHP may be sent to the Seller and the Top Bidder via an in-app message, an e-mail, a text message, a voice mail, a link being added to the homepage on a social media website e.g. Facebook homepage.

The system may suggest they close the deal as the difference between the Top Bid and the AHP for that vehicle is small 307.

In this case, the Top Bidder can make a new bid 308. The Top Bidder may place a new bid that is closer to or equal to the AHP.

The Seller may then accept the new bid 309. Alternatively the Seller may reconsider the previous Top Bid and accept it as a winning bid. In one embodiment when the Seller accepts the electronic bid the system may automatically perform a transaction that may include monetary exchange via cash, credit card, debit card or other such means. When performing a monetary transaction the winning bidder's account may be debited with the value of the winning bid, while the seller's account may be credited with the amount of the winning bid.

In one embodiment of the auction there may a percentage commission that the system may deduct at the time of performing the monetary transaction e.g. a 4% commission.

Following closing and settlement, the process may be ended and the auction concluded 310.

The delta between AHP and Top bid may be checked 304. If the delta is negative 304*b* the system may contact Seller 311. The electronic message to negotiate may be received by the seller in the app.

The system may send the AHP to the Seller 312. The system may suggest to the Seller to accept the Top Bid as the top bid is higher than the AHP 313. Seller may then accept the bid 309. In one embodiment when the Seller accepts the electronic bid the system may automatically perform a transaction that may include monetary exchange via cash, credit card, debit card or other such means. Following closing and settlement, the process may be ended and the auction concluded 310.

The system may check the delta between the AHP and Top bid 304. If the delta is large 304*c* the system may contact the Top Bidder 314. The electronic message to negotiate may be received by the top bidder in the app.

The system may send the AHP to the Top Bidder 315. The system may suggest to the Top Bidder to up the bid as the difference between AHP and Top Bid is large 316.

In this case, the Top bidder can make a new bid 308. The Top Bidder may place a new bid that is closer to or equal to the AHP.

The Seller may then accept the bid 309. Alternatively the Seller may reconsider the previous Top Bid and accept it as a winning bid. In one embodiment when the Seller accepts the electronic bid the system may automatically perform a transaction that may include monetary exchange via cash, credit card, debit card or other such means. Following closing and settlement, the process may be ended and the auction concluded 310.

Figure 4:
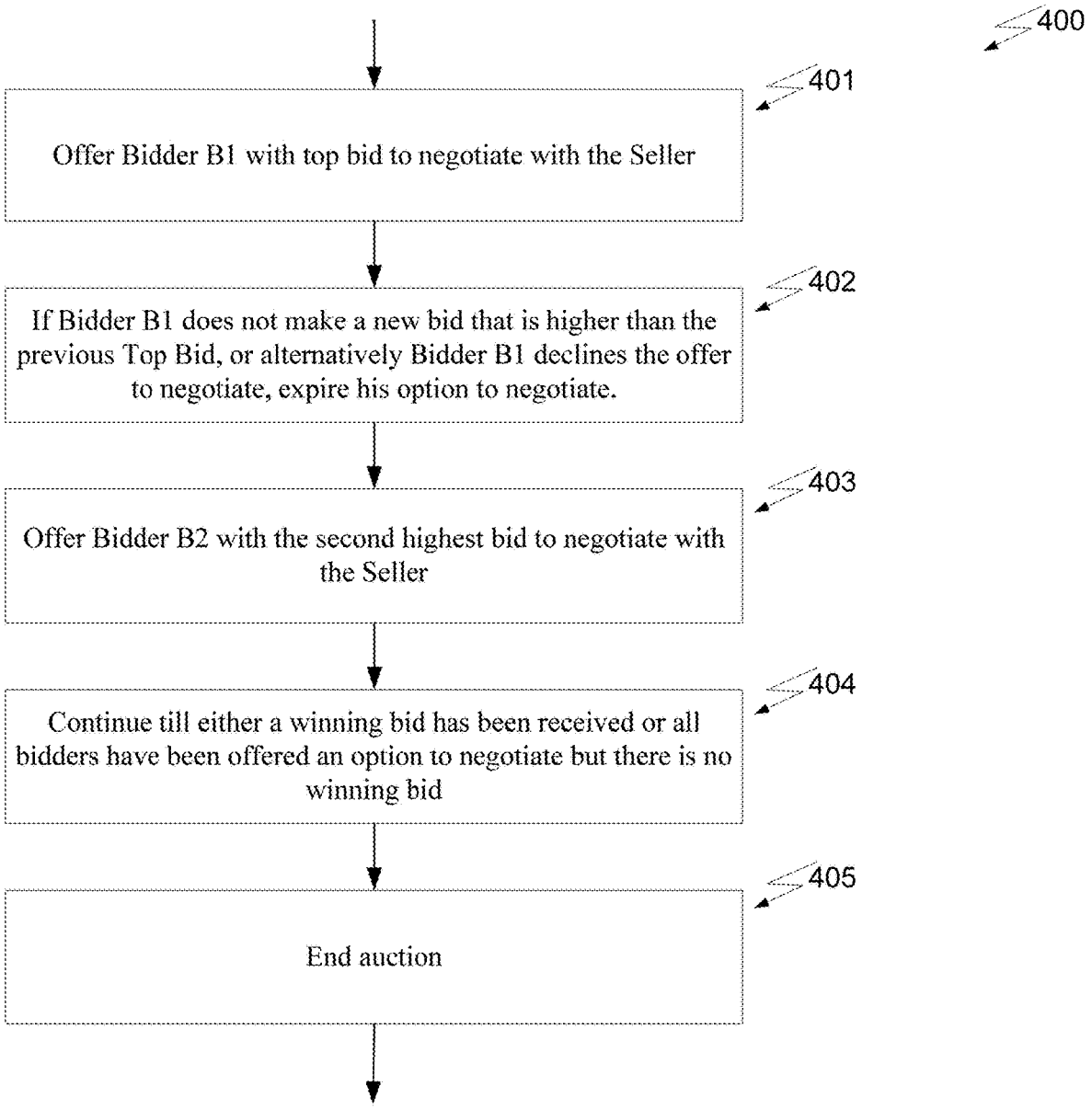
FIG. 4 is a flow diagram illustrating progressive offering of post-auction negotiation to second and subsequent "best bidders".

FIG. 4 shows the process of offering the top to down bidders to negotiate a final bid to conclude an auction 400.

The system may offer Bidder B1 with the Top Bid an opportunity to negotiate with the Seller 401. Bidder B1 may preferably be offered to negotiate via the app. If Bidder B1 is not using the app, then the bidder may be informed via more traditional methods like an e-mail or a text message and preferably the link to download the app e.g. from Google PlayStore or Apple AppStore may be embedded in this message.

If Bidder B1 does not make a new offer that is higher than the previous Top Bid, or alternatively Bidder B1 declines the offer to negotiate, then his option to negotiate may expire 402. There may be a time limit when expiring an offer made to a bidder. Preferably this timer may be configurable. Preferably the expiry time may also be configurable based on the past behaviour of the bidder.

After expiry, the system may offer Bidder B2 with the second highest bid an opportunity to negotiate with the Seller 403.

This may continue until either a winning bid has been received or all bidders have been offered the chance to negotiate but there was no winning bid 404. In one embodiment after seller has accepted the bid, the bidder may be notified that the bid has been accepted. This notification may be via in-app message, e-mail, text message, IM, phone call and the like.

In one embodiment when the Seller accepts the electronic bid the system may automatically perform a transaction that may include monetary exchange via cash, credit card, debit card or other such means. After this, the Auction may be ended 405.

Figure 5:
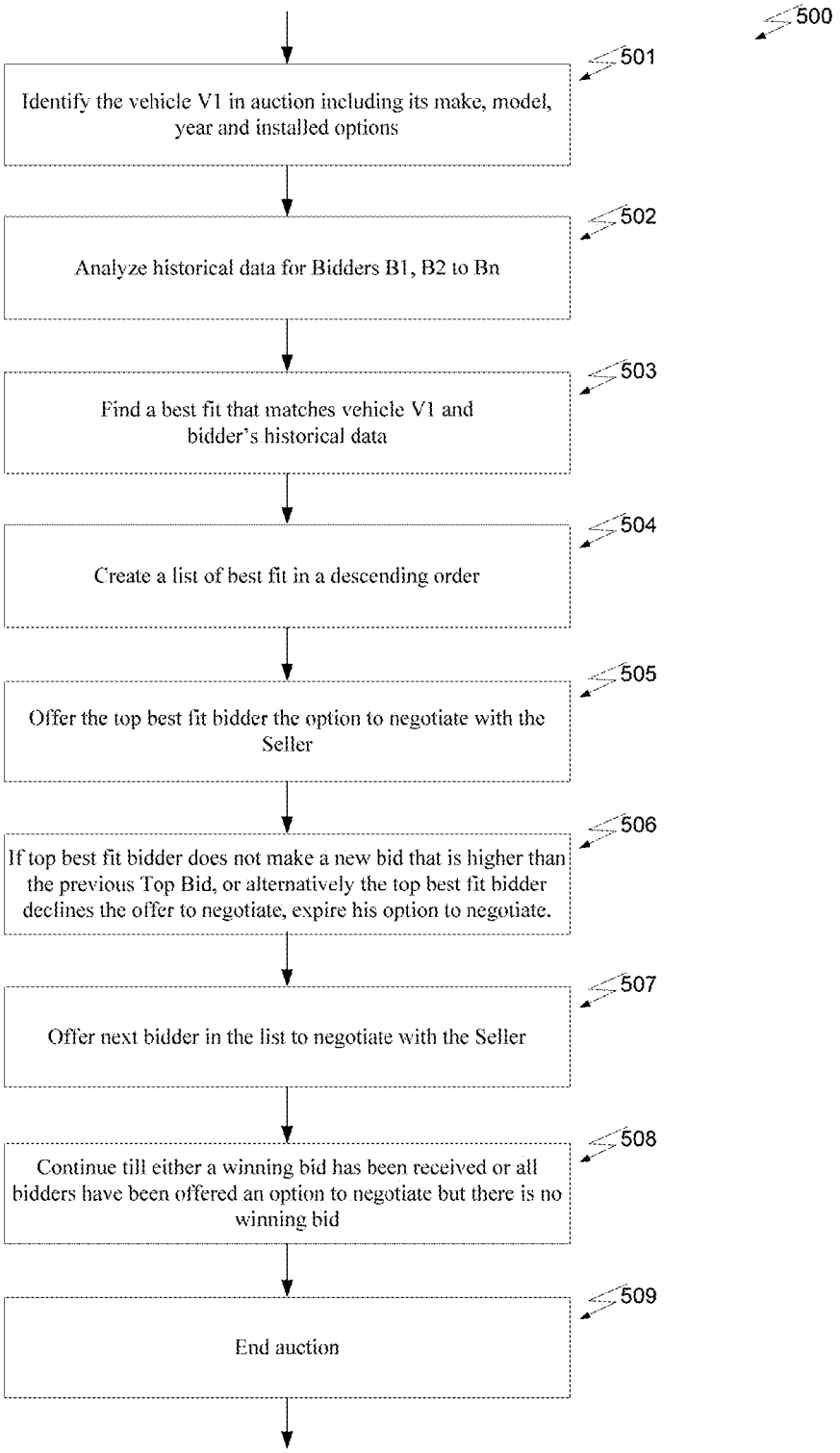
FIG. 5 is a flow diagram illustrating an embodiment for determination of best fit bidder.

FIG. 5 shows on embodiment of the method 500. The vehicle V1 in auction is identified including its make, model, year and installed options 501.

Historical data may be analyzed for Bidders B1, B2 to Bn 502 who were participating in the auction. The historical data for bidders may be stored in the system and accumulates over time as bidders and sellers interact with the system. Alternatively such data may also be acquired from third parties.

The system may try to find a best fit that matches vehicle V1 and bidder's historical data 503. In order to find the best fit bidder, the system may use historical data for each bidder e.g. the past bids, past winning bids, the kind of vehicles that the bidder has been interested in and bid on, what were the ranges of the bids as compared to the winning bids, did the bidder have any winning bids, what was the percentage of the winning bids as compared to all the bids made by a particular bidder, in a particular auction how many bids did the bidder make, what was his starting bid and what was his final bid, etc. For example if a certain bidder has been consistently bidding and winning bids on high value, low mileage, luxury vehicles, then match the bidder to the vehicle if the vehicle in the auction fits this criteria. The system may also refer to stated preferences or profile details specified by the bidder.

Create a list of best fit in a descending order 504. The bidder whose past bidding history best fits a given vehicle in an auction is at the top of the list followed by the next best fit bidder and so on. For example a Honda CRV 2010 is on the auction block, and Bidder B2 has the most winning bids for Honda CRVs in the past year, therefore it can be concluded that Bidder B2 is the best suited since he "specializes" in Honda CRVs and should be given the first chance to negotiate with the seller.

The system may then offer the top best fit bidder the option to negotiate with the Seller 505.

If top best fit bidder does not make a new bid that is higher than the previous Top Bid, or alternatively the top best fit bidder declines the offer to negotiate, expire his option to negotiate 506.

The system may proceed to offer the next bidder in the list the opportunity to negotiate 507. This may continue until either a winning bid has been received or all bidders have been offered to negotiate but there was no winning bid 508. In one embodiment after seller has accepted the bid, the bidder may be notified that the bid has been accepted. This notification may be via in-app message, e-mail, text message, IM, phone call and the like.

In one embodiment when the Seller accepts the electronic bid the system may automatically perform a transaction that may include monetary exchange via cash, credit card, debit card or other such means.

Figure 6:
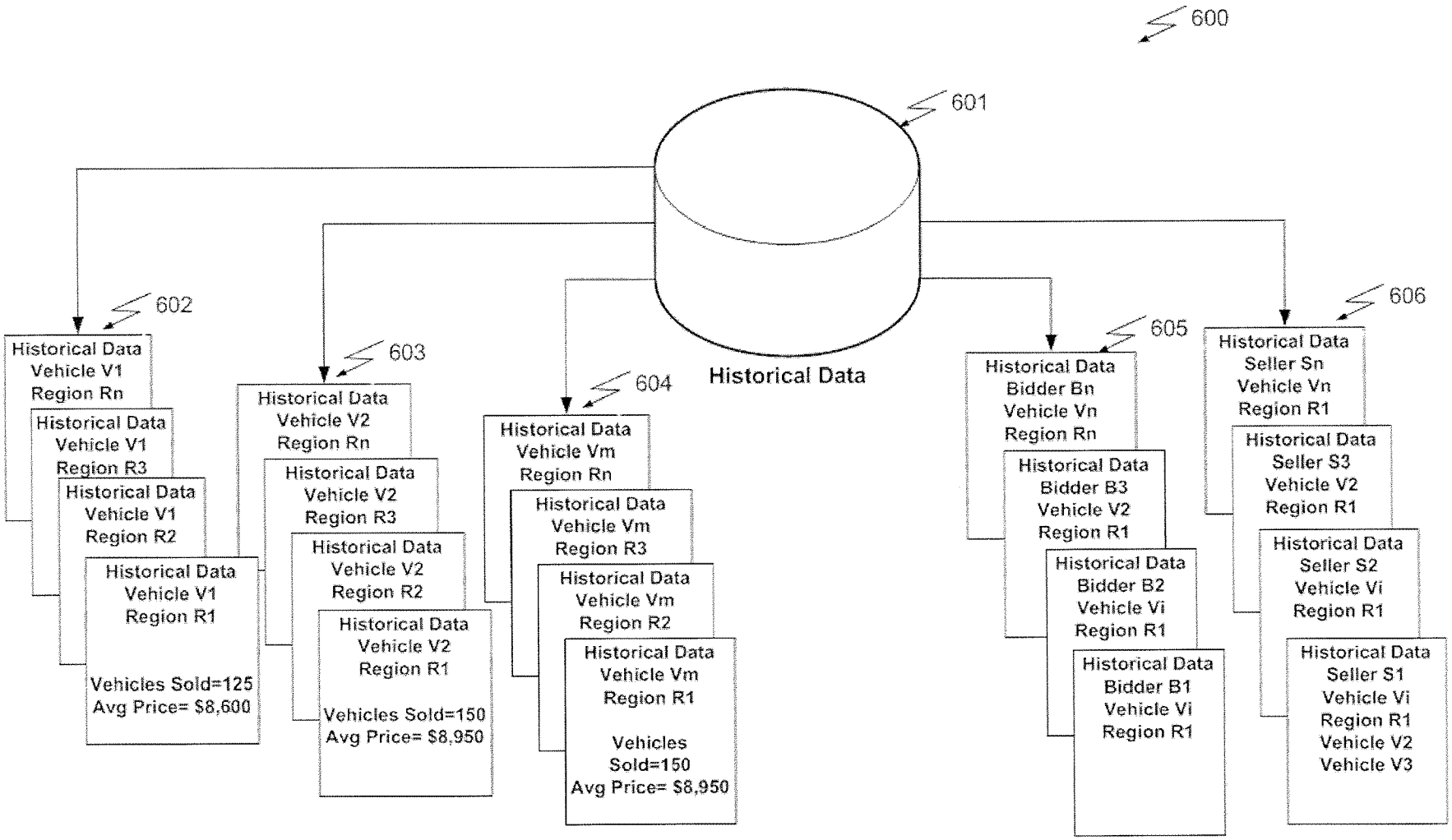
FIG. 6 is a diagram showing sample historical sales data for determination of an average historical price.

FIG. 6 shows an exemplary database 601 that may be used for storing the historical data of vehicles, sellers and bidders.

For example Tables 602 may be used to store the data for Vehicle 1 in different regions. For example the number of sales of Vehicle V1 and its average price in Region R1, number of sales of Vehicle V1 and its average price in Region R2, up to Region Rn.

For example Tables 603 may be used to store the data for Vehicle V2 in different regions. For example the number of sales of Vehicle V2 and its average price in Region R1, number of sales of Vehicle V2 and its average price in Region R2, up to Region Rn.

There may be several tables in-between Table 603 and Table 604 that store the value of different vehicles in different regions such that Tables 604 may be used to store the data for Vehicle Vm in different regions. For example the number of sales of Vehicle Vm and its average price in Region R1, number of sales of Vehicle V2 and its average price in Region R2, up to Region Rn.

For example Tables 605 may be used to store data for different bidders and their bidding history, which may include but is not limited to the bidding patterns, the bidding trends, past bids, the makes, models, years, mileage, condition, history etc. of vehicles they bid on, condition of vehicles where the bid on (e.g. is this bidder exclusively only bidding on vehicles that have had an accident), the makes, models, years, mileage, condition, history etc. of vehicles where they had a winning bid, how promptly they made their payments, did they pick up the vehicles on time, did they make any claims and/or returns, any disputes and how these disputes were resolved, reviews of bidders by sellers etc.

For example Tables 606 may be used to store data for different sellers for example their selling history, which may include but is not limited to the kinds of vehicles that the sold e.g. the makes, models, years, mileage, condition, history of vehicles etc. that they sold at the auction, what were the trends and patterns of the winning bids, the time it took to conclude an auction, claims and/or retunes, any disputes and how these disputes were resolved, reviews of sellers provided by bidders, etc.

There may be other methods to store this information e.g. using a list. There may be other data to assist in this process for example data acquired from third parties like vehicle histories, reviews, These descriptions exemplify only some of the several possible embodiments of the invention and are not meant to be exhaustive.

It should be understood that although the term application has been used as an example in this disclosure but in essence the term may also imply to any other piece of software code where the embodiments are incorporated. The software application can be implemented in a standalone configuration or in combination with other software programs and is not limited to any particular operating system or programming paradigm described here.

The computer program comprises: a computer usable medium having computer usable program code, the computer usable program code comprises: computer usable program code for presenting graphically to the users options for scrolling via the touch-screen interface.

The examples noted here are only for illustrative purposes and there may be further implementation embodiments possible with a different set of components. While several embodiments are described, there is no intent to limit the disclosure to the embodiment or embodiments disclosed herein. On the contrary, the intent is to cover all practical alternatives, modifications, and equivalents.

The invention claimed is:

1. A method of computer-mediated negotiation following an inconclusive online auction of a vehicle offered for sale by a seller, the vehicle having a specific make and a specific model, bids for the inconclusive online auction being submitted from a plurality of bidders via at least one of an app on an electronic mobile device or via an Internet browser, the inconclusive online auction having a previous best bid that was not accepted by the seller, the method comprising:

retrieving, by a computer, historical pricing data of vehicles having the same or similar specific make and specific model, and from the historical pricing data of vehicles having the same or similar specific make and specific model, establishing a historical price;

following the inconclusive online auction of the vehicle:

determining that there was at least one bid in the inconclusive online auction;

determining that the seller did not accept any bid during the inconclusive online auction;

comparing the previous best bid and the historical price;

determining, based on comparing the previous best bid and the historical price, whether to contact the seller or to contact a best bidder;

responsive to determining to contact the seller:

sending a seller communication to the seller, the seller communication indicative to the seller that the historical price is less than the previous best bid and requesting acceptance of the previous best bid;

responsive to sending the seller communication, receiving from the seller an indication of acceptance the previous best bid; and responsive to receiving the indication from the seller of acceptance of the previous best bid, closing the inconclusive online auction at the previous best bid without reopening the inconclusive online auction broadly to other bidders; and responsive to determining to contact the best bidder:

analyzing winning bidding history for a respective bidder of the plurality of bidders in which the respective bidder submitted a winning bid in at least one other auction for a vehicle with the specific make and the specific model;

selecting, from the plurality of bidders and based on the analysis of the winning bidding history for the at least one other auction, the best bidder from the inconclusive online auction, the best bidder having a previous bid that was not accepted by the seller during the inconclusive online auction;

sending a bidder communication to the best bidder, the bidder communication indicative to the best bidder of the historical price being greater than the previous best bid and indicative to the best bidder to submit a bid that is higher than the previous best bid;

responsive to sending the bidder communication, receiving a higher bid from the best bidder; and responsive to receiving acceptance by the seller of the higher bid, closing the inconclusive online auction at the higher bid without reopening the inconclusive online auction broadly to other bidders.

2. The method of claim 1, wherein bidding by the best bidder, responsive to receiving the bidder communication, is time-limited.

3. The method of claim 2, wherein following expiry of the time limit for the best bidder without a negotiated closing price, further comprising permitting the seller and a second-best bidder, in light of the historical price, to negotiate a closing price for a transaction of the vehicle without reopening the inconclusive online auction broadly to other bidders.

4. The method of claim 1, wherein retrieving the historical pricing data for a first vehicle and a second vehicle and for a first region and a second region comprises:

retrieving at least a part of a first table for the first vehicle, the first table being arranged in subparts, with a first subpart comprising first vehicle historical data in the first region and a second subpart comprising first vehicle historical data in the second region; and retrieving at least a part of a second table for the second vehicle, the second table being arranged in subparts, with a first subpart comprising second vehicle historical data in the first region and a second subpart comprising second vehicle historical data in the second region.

5. The method of claim 1, further comprising:

determining, based on comparing the previous best bid and the historical price, whether to contact both the seller and the best bidder or to contact only the best bidder; and responsive to determining to contact both the seller and the best bidder:

sending a seller-bidder communication to both the seller and the best bidder, the seller-bidder communication indicative to the seller and the best bidder to settle on a price that is a difference between the previous best bid and the historical price.

6. The method of claim 5, wherein, responsive to determining that the historical price is less than the previous best bid, determine to only contact the seller;

wherein, responsive to determining that the historical price is greater than the previous best bid by a certain margin, determine to only contact the best bidder; and wherein, responsive to determining that the historical price is greater than the previous best bid and less than the certain margin, determine to contact both the seller and the best bidder.

7. The method of claim 5, further comprising:

responsive to determining that the best bidder is not using the app:

selecting a mode of electronic communication other than via the app; and sending, via the selected mode of electronic communication, the bidder communication to the best bidder.

8. The method of claim 1, wherein analyzing the winning bidding history comprises determining a number of winning bids for the vehicles with the specific make and the specific model.

9. The method of claim 8, wherein the best bidder selected has a highest number of winning bids for the vehicles with the specific make and specific model.

10. The method of claim 8, wherein the best bidder selected has a highest number of winning bids for the vehicles with the specific make and specific model within a specified time period.

11. The method of claim 1, wherein analyzing the winning bidding history comprises determining a percentage of past winning bids as compared to all bids made by the respective bidder.

12. The method of claim 1, wherein analyzing the winning bidding history comprises determining a starting bidding and a final bid for the respective bidder.

13. The method of claim 1, wherein analyzing the winning bidding history comprises determining a number of bids that the respective bidder made for a particular auction.

14. The method of claim 1, wherein analyzing the winning bidding history comprises analyzing past winning bids made by the respective bidder.

15. The method of claim 1, wherein analyzing the winning bidding history is for a specific time period.

16. A system comprising:

a memory configured to store an auction module that conducts an online auction for a vehicle offered for sale by a seller, the auction module being programmed for receiving bids from a plurality of bidders, the bids being submitted via at least one of an app on an electronic mobile device or via an Internet browser, and the auction module being programmed to determine that an auction has timed out without a successful bid by any of the bidders including a best bidder having a previous best bid that was not accepted by the seller during the online auction; and a processor in communication with the memory, the processor configured to:

determine a historical price from historical pricing data of vehicles having a specific make and a specific model in common with a target vehicle;

receive an indication from the auction module that an auction of the target vehicle timed out without a successful bid resulting in an inconclusive online auction;

in response to receiving the indication that the auction of the target vehicle timed out without the successful bid:

compare the previous best bid and the historical price;

determine, based on comparing the previous best bid and the historical price, whether to contact the seller or to contact a best bidder;

responsive to determining to contact the seller:

send a seller communication to the seller, the seller communication indicative to the seller that the historical price is less than the previous best bid and requesting acceptance of the previous best bid;

responsive to sending the seller communication, receive from the seller an indication of acceptance the previous best bid; and responsive to receiving the indication from the seller of acceptance of the previous best bid, close the online auction at the previous best bid without reopening the online auction broadly to other bidders; and responsive to determining to contact the best bidder:

analyze winning bidding history for a respective bidder of the plurality of bidders in which the respective bidder submitted a winning bid in at least one other auction for a vehicle with the specific make and the specific model;

select, from the plurality of bidders and based on the analysis of the winning bidding history for the at least one other auction, the best bidder from the inconclusive online auction, the best bidder having a previous bid that was not accepted by the seller during the inconclusive online auction;

send a bidder communication to the best bidder, the bidder communication indicative to the best bidder of the historical price being greater than the previous best bid and indicative to the best bidder to submit a bid that is higher than the previous best bid;

responsive to sending the bidder communication, receive a higher bid from the best bidder; and responsive to receiving acceptance by the seller of the higher bid, close the online auction at the higher bid without reopening the online auction broadly to other bidders.

17. The system of claim 16, wherein the processor is further configured to:

determine, based on comparing the previous best bid and the historical price, whether to contact both the seller and the best bidder or to only contact the best bidder; and responsive to determining to contact both the seller and the best bidder:

send a seller-bidder communication to both the seller and the best bidder, the seller-bidder communication indicative to the seller and the best bidder to settle on a price that is a difference between the previous best bid and the historical price.

18. The system of claim 17, wherein, responsive to determining that the historical price is less than the previous best bid, the processor is configured to determine to only contact the seller;

wherein, responsive to determining that the historical price is greater than the previous best bid by a certain margin, the processor is configured to determine to only contact the best bidder; and wherein, responsive to determining that the historical price is greater than the previous best bid and less than the certain margin, the processor is configured to determine to contact both the seller and the best bidder.

19. The system of claim 16, wherein the processor is configured to analyze the winning bidding history by determining a number of winning bids for the vehicles with the specific make and the specific model.

20. The system of claim 19, wherein the processor is configured to select the best bidder that has a highest number of winning bids for the vehicles with the specific make and specific model.

21. The system of claim 19, wherein the processor is configured to select the best bidder that has a highest number of winning bids for the vehicles with the specific make and specific model within a specified time period.

22. The system of claim 16, wherein the processor is configured to analyze the winning bidding history by determining a percentage of past winning bids as compared to all bids made by the respective bidder.

23. The system of claim 16, wherein the processor is configured to analyze the winning bidding history by determining a starting bidding and a final bid for the respective bidder.

24. The system of claim 16, wherein the processor is configured to analyze the winning bidding history by determining a number of bids that the respective bidder made for a particular auction.

25. The system of claim 16, wherein the processor is configured to analyze the winning bidding history by analyzing past winning bids made by the respective bidder.

26. The system of claim 16, wherein the processor is configured to analyze the winning bidding history for a specific time period.

* * * * *